United States Patent [19]

Mori et al.

[11] Patent Number: 4,904,972

[45] Date of Patent: Feb. 27, 1990

[54] GAS-INSULATED STATIONARY INDUCTION ELECTRICAL APPARATUS

[75] Inventors: Etsunori Mori; Tadashi Kiuchi; Kiyoto Hiraishi; Masaru Watanabe, all of Hitachi, Japan

[73] Assignee: Hitachi, Ltd., Tokyo, Japan

[21] Appl. No.: 372,309

[22] Filed: Jun. 28, 1989

[51] Int. Cl.[4] ..... H01F 27/08

[52] U.S. Cl. ..... 336/55; 336/57; 336/58; 336/94

[58] Field of Search ..... 336/55, 57, 58, 94; 174/15.1, 17 LF; 310/52, 54, 55, 57

[56] References Cited

U.S. PATENT DOCUMENTS

| | | | |
|---|---|---|---|
| 2,872,651 | 2/1959 | Treanor | 174/15.1 X |
| 3,634,798 | 1/1972 | Astleford, Jr. | 336/92 |
| 3,668,583 | 6/1972 | Nichols | 336/60 X |
| 4,745,677 | 5/1988 | Shichi | 336/58 X |

FOREIGN PATENT DOCUMENTS

| | | | |
|---|---|---|---|
| 56-107526 | 8/1981 | Japan | 336/58 |
| 58-158906 | 9/1983 | Japan | 336/58 |
| 61-111513 | 5/1986 | Japan | 336/58 |

*Primary Examiner*—Thomas J. Kozma

*Attorney, Agent, or Firm*—Antonelli, Terry & Wands

[57] ABSTRACT

A gas-insulated stationary induction electrical apparatus comprising a first closed vessel sealingly accommodating therein a main body having an iron core formed by laminating silicon steel sheets and also having at least one set of windings each consisting of a high-voltage winding and a low-voltage winding which are disposed apart from the iron core on both sides thereof, and a liquid medium for effecting cooling and insulation; a second closed vessel formed of an insulating material and sealingly accommodating therein the first closed vessel; and an insulating gas under a predetermined pressure which is sealed within the gap between the first and second vessels, wherein the induction apparatus main body is submerged in the liquid medium.

5 Claims, 4 Drawing Sheets

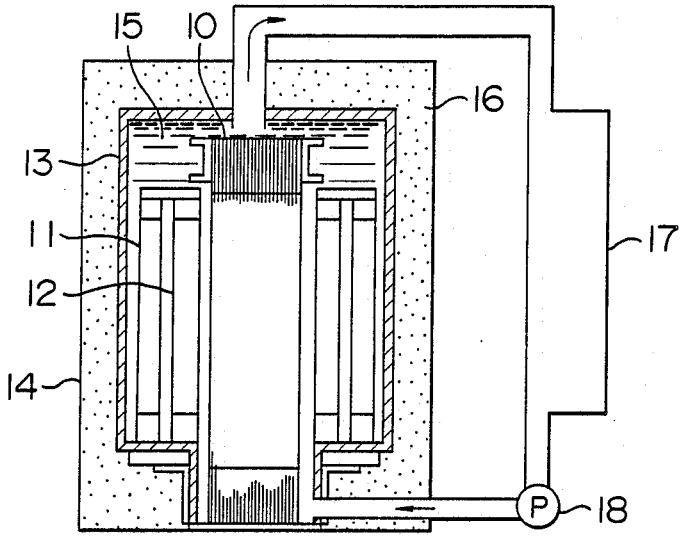
FIG. 2
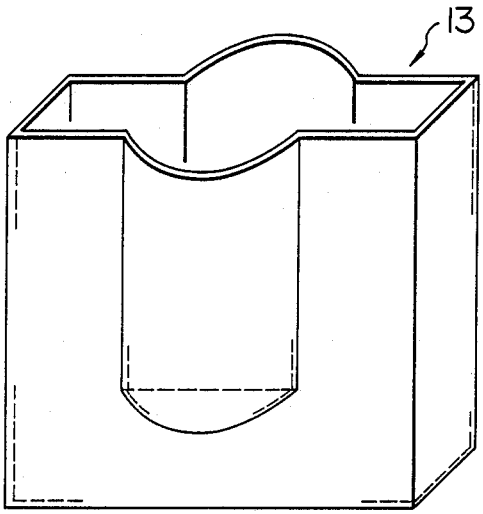

GAS-INSULATED STATIONARY INDUCTION ELECTRICAL APPARATUS

BACKGROUND OF THE INVENTION

The present invention relates to an induction electrical apparatus and, more particularly, to a gas-insulated type stationary induction electrical apparatus.

A conventional induction electrical apparatus, such as that disclosed in Japanese Patent Examined Publication No. 61-27888, is provided with a diffuser and a spray whereby a liquid serving as a cooling and insulating medium is evenly dispersed onto such members of the apparatus as the iron core and the windings. The "electromagnetic induction equipment" disclosed in Japanese Patent Unexamined Publication No. 58-158906 is provided with a vessel with insulating characteristics in which parts of the iron core and the windings are dipped in a condensable cooling liquid and which covers the outer and lower sides of the windings, various cavity portions of the apparatus being filled with a casting resin. With the arrangements of both these two types of induction apparatus, however, it is difficult to ensure an adequate cooling effect.

Japanese Patent Unexamined Publication No. 61-111513 discloses a "vaporization-cooled induction electrical apparatus" provided with a first closed vessel containing $SF_6$ gas under a high pressure and a coolant, and a second closed vessel accommodating the first closed vessel, the gap between these vessels being filled with a compressed gas under an intermediate pressure, the apparatus thus being a stationary induction electrical apparatus having a double closed-vessel structure.

In the above-described gas-insulated induction electrical apparatus, $SF_6$ gas having a high level of insulating ability is used as an insulating medium, and the gas is also used as a cooling medium. However, when the induction electrical apparatus has a large capacity, since a large amount of heat is generated by the apparatus, the heat transfer rate achievable with $SF_6$ gas often proves to be insufficient.

The cooling effect provided also falls short of adequacy when the apparatus concerned is an induction electrical apparatus provided both with a vaporization cooling system in which a coolant formed of a liquid having a low boiling point is dispersed onto the iron core, etc. so that the temperature is caused to drop utilizing the heat of vaporization, and with a $SF_6$ gas insulating system, and when the apparatus has a large capacity and can generate a large amount of heat. Particularly when the iron core used has a complicated structure, it is impossible to prevent localized overheating of the iron core. When such an iron core undergoes localized overheating, and when the iron core is formed using silicon steel sheets as the material, Si contained in the steel chemically reacts with $SF_6$ gas to generate $SiF_4$, which may promote corrosion of the silicon steel sheets. This chemical reaction occurs in the following manner:

$$2SF_6 + 6H_2O \rightarrow 2SO_2 + 12HF + O$$

$$SF6 + O_2 \rightleftharpoons SO_2 + 3F_2$$

$$Si + 2F_2 \rightarrow SiF_4$$

The "localized overheating" will be described further and in detail. As shown in FIGS. 4A, 4B and FIG. 5, an iron core in general has a structure including a core main leg 41, a core upper yoke 42, a core lower yoke 43, and a core side leg 44, etc. The illustrated structure of the iron core is formed by laminating a plurality of silicon steel sheets 45. If fine gaps 46 (see FIG. 5) are formed in a junction A of the steel plates 45, when magnetic flux 47 flowing through the iron core is passing through the junction A, the flux encounters a large magnetic resistance at the gaps 46 in the junction A, and it is thus caused to transfer to an adjacent silicon steel sheet 45. As a result, the flux density increases at the location where this transfer occurs, and this leads to localized overheating.

FIG. 6 shows a graph in which the temperature of the iron core is used as the parameter, and in which the axis of ordinate represents the amount of gases ($SO_2$, $SiF_4$, etc.) generated, while the axis of abscissa represents the amount of moisture within the associated first closed vessel. As will be clearly understood from this graph, when the iron core is locally overheated, silicon (Si) contained in the iron core may chemically react with a small amount of water ($H_2O$), thereby leading to the generation of the gas which may promote corrosion of the iron core.

SUMMARY OF THE INVENTION

The present invention has been accomplished in view of the above-stated points. It is an object of the present invention to provide a gas-insulated stationary electrical induction apparatus capable of achieving an enhanced cooling effect in the cooling of an iron core formed by silicon steel sheets.

A gas-insulated stationary induction apparatus according to the present invention comprises: a first closed vessel sealingly enclosing and accommodating therein an induction electrical apparatus main body having an iron core formed by laminating silicon steel sheets and also having at least one set of windings each consisting of a high-voltage winding and a low-voltage winding which are disposed in such a manner as to be on both sides of the iron core and spaced apart therefrom, and a liquid medium for effecting cooling and insulation; a second closed vessel formed of an insulating material and sealingly enclosing and accommodating therein the first closed vessel; and an insulating gas under a predetermined pressure which is sealed within the gap between the first and second vessels, wherein the induction electrical apparatus main body is submerged in the liquid medium.

In the apparatus of the present invention, the medium for effecting cooling and insulation acts mainly to cool the iron core and the windings and also serves as an insulating medium within the windings. Also in the apparatus, $SF_6$ gas serves as an insulating medium which acts mainly to maintain the insulation of high-voltage portions.

BRIEF DESCRIPTION OF THE DRAWINGS

FIG. 1 is a vertical sectional view schematically showing one embodiment of the present invention;

FIG. 2 is a perspective view of a first closed vessel of the embodiment;

DESCRIPTION OF THE PREFERRED EMBODIMENTS

Figure 3:
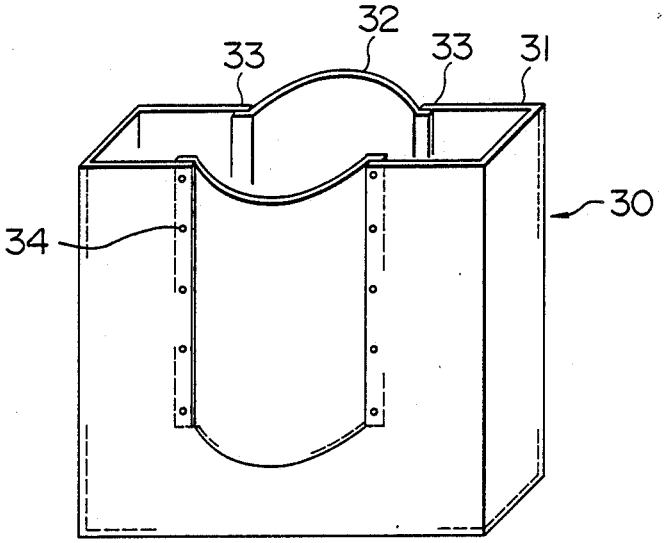
FIG. 3 is a perspective view of a first closed vessel of another embodiment of the present invention.
Figure 4A:
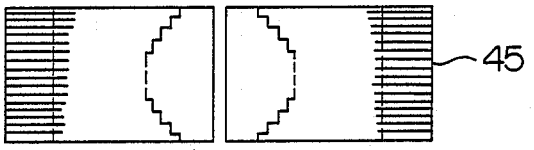
FIGS. 4A and 4B are a plan view and a front view, respectively, which show an iron core structure of the first embodiment.
Figure 4B:
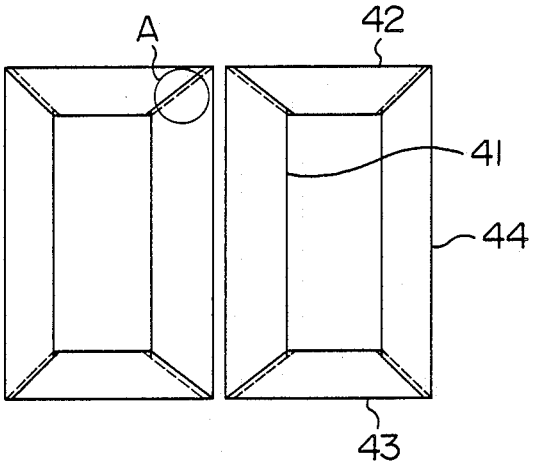
Figure 5:
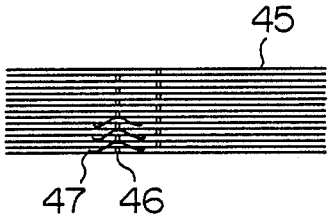
FIG. 5 is a view used to explain localized overheating due to the flow of magnetic flux within the iron core of the first embodiment.
Figure 6:
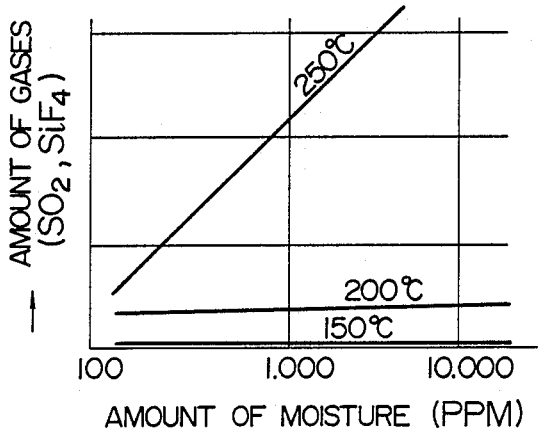
FIG. 6 is a graph showing data on generation of gases resulting from localized overheating.

The present invention will be described hereunder with respect to the illustrated embodiments thereof.

FIG. 1 shows one embodiment of the present invention. The apparatus of the present invention comprises a main body of the induction electrical apparatus which includes an iron core 10 formed of laminated silicon steel sheets, a high-voltage winding 11, and a low voltage winding 12, which are arranged in turn. The high-voltage winding 11 and the high-voltage winding 12 are disposed in such a manner as to be on both sides of the iron core 10 and spaced apart therefrom.

The main body of the induction electrical apparatus is also completely submerged in a pearl fluorocarbon liquid 15 a part of which is sealed within a first closed vessel 13 and which serves as a cooling and insulating liquid medium. The entire structure of the first closed vessel 13 is formed of an insulating material.

A second closed vessel 14 accommodates therein the first closed vessel 13. $SF_6$ gas (under a gauge pressure of, e.g., 4.0 kg/cm$^2$) is charged and sealed in the gap between the first and second closed vessels 13 and 14, and serves as an insulating gas.

The first closed vessel 13 communicates through conduits with a cooling device 17 and a liquid delivers pump 18. Specifically, one conduit extends from an exit formed in the vicinity of the upper portion of the first closed vessel 13, penetrates through the wall portion of an upper portion of the second closed vessel 14, and communicates with an entrance of the cooling device 17 disposed on the outside of the second vessel 14. Another conduit extends from an exit of the cooling device 17, joints with the liquid delivery pump 18 also disposed on the outside of the second closed vessel 14, and, from the pump 18, extends through a wall portion of the second closed vessel 14 to communicate with an entrance to the first closed vessel 13.

With this construction, therefore, that part of the pearl fluorocarbon liquid 15 (circulating liquid) which has been heated within the first closed vessel 13 flows from the exit of the first closed vessel 13 through the conduit into the cooling device 17. After the part of the circulating liquid 15 has been cooled by the device 17, it flows into the liquid delivery pump 18. The cooled part of the liquid 15 is delivered by the liquid delivery pump 18 through the associated conduit and the entrance of the first closed vessel 13 to the inside of the vessel 13. Although in the illustrated example the circulating liquid 15 flows from a lower level to an upper level within the first closed vessel 13, the direction of flow may be the opposite.

By virtue of the above-described arrangement of the induction electrical apparatus of the present invention, the iron core 10 is completely submerged in the circulating liquid 15 (cooling and insulating medium) within the first closed vessel 13 formed of an insulator, thereby preventing any localized overheating. Since this ensures that corrosion of the iron core does not occur, it is possible to prevent any increase in the iron core loss which might otherwise occur when the iron core 10 is used for a long period.

As shown in FIG. 2, the first closed vessel 13 in which a part of the cooling and insulating medium 15 is sealed and accommodated is integrally formed of an insulating material.

In another embodiment, as shown in FIG. 3, a first closed vessel 30 mainly includes first portions 32 having curved portions for accommodating the iron core 10, and a second portion 31 for accommodating the winding portions around the iron core 10, which portions are individually manufactured. These members 32 and 31 are assembled by fixing their respective edge portions in place by means of clamping bolts 34 through sealing members 33. With this embodiment, it is also possible to allow the cooling and insulating medium 15 sealed and accommodated in the first closed vessel 30 to perform its functions properly, while the medium 15 is prevented from being exposed to the gas side.

Figure 7:
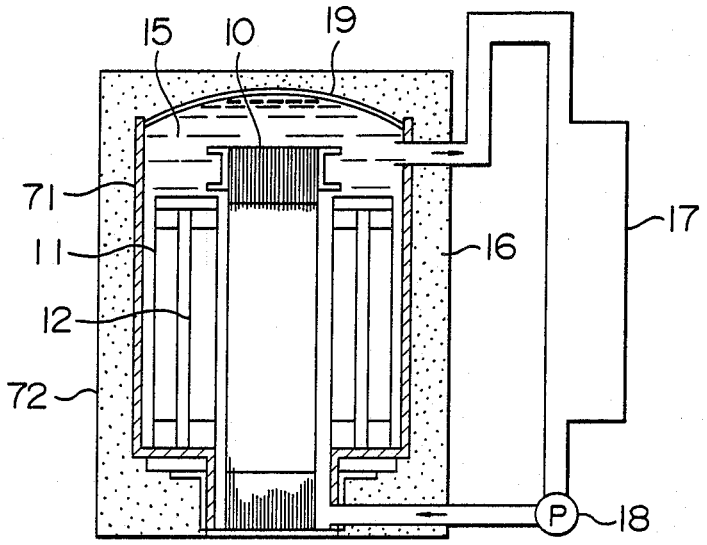
FIG. 7 is a vertical sectional view schematically showing still another embodiment of the present invention.

FIG. 7 shows still another embodiment of the present invention. The upper portion of a first closed vessel 71 is formed by an elastic diaphragm 19 which is vertically movable. Specifically, the diaphragm 19 moves vertically in accordance with the volume of gas generated in that part of the circulating liquid 15 which is sealed and accommodated in the first closed vessel 71 and with the volume of the part of the circulating liquid 15 which is within the first closed vessel 71.

What is claimed is:

1. A gas-insulated stationary induction electrical apparatus comprising:

a first closed vessel sealing accommodating therein a main body having an iron core formed by laminating silicon steel sheets and also having at least one set of windings each consisting of a high-voltage winding and a low-voltage winding which are disposed apart from said iron core on both side thereof, and a liquid medium for effecting cooling and insulation;

a second closed vessel formed of an insulating material and sealingly accommodating therein said first closed vessel; and an insulating gas under a predetermined pressure which is sealed within the gap between said first and second vessels, wherein said main body is submerged in said liquid medium.

2. An induction electrical apparatus according to claim 1, wherein said first closed vessel has a circulating pump and a cooling device whereby said medium within said first closed vessel is cooled and circulated.

3. An induction electrical apparatus according to claim 1, wherein said first closed vessel is formed integrally of an insulating material.

4. An induction electrical apparatus according to claim 1, wherein said first closed vessel is formed by a plurality of insulating members.

5. An induction electrical apparatus according to claim 1, wherein an upper portion of said first closed vessel is formed by a vertically movable diaphragm.

* * * * *